US005845435A

United States Patent [19]

Knudson

[11] Patent Number: 5,845,435

[45] Date of Patent: Dec. 8, 1998

[54] FASTENING SUPPORT DEVICES AND SYSTEMS FOR SHIELDED GUTTERS

[76] Inventor: Gary A. Knudson, 30401 Heavenly Ct., Evergreen, Colo. 80439

[21] Appl. No.: 924,678

[22] Filed: Sep. 5, 1997

Related U.S. Application Data

[63] Continuation-in-part of Ser. No. 410,742, Mar. 27, 1995, abandoned.

[51] Int. Cl.[6] ..... E04D 13/00

[52] U.S. Cl. ..... 52/11; 52/13; 52/96; 248/48.1

[58] Field of Search ..... 52/11, 12, 15, 52/16, 96, 60, 94; 248/48.1, 48.2, 221.4; 24/295

[56] References Cited

U.S. PATENT DOCUMENTS

| | | | |
|---|---|---|---|
| 2,672,832 | 3/1954 | Goetz . | |
| 3,752,428 | 8/1973 | Trostle et al. | 248/48.2 |
| 4,000,587 | 1/1977 | Weber | 248/48.1 X |
| 4,241,548 | 12/1980 | Rowe | 52/11 |
| 4,630,338 | 12/1986 | Osterland | 24/295 X |
| 4,757,649 | 7/1988 | Vahldieck . | |
| 4,876,827 | 10/1989 | Williams | 52/12 |
| 5,138,529 | 8/1992 | Colton | 24/295 X |
| 5,141,192 | 8/1992 | Adams | 248/48.1 X |
| 5,388,377 | 2/1995 | Faulkner . | |

FOREIGN PATENT DOCUMENTS

| | | | |
|---|---|---|---|
| 2608157 | 9/1977 | Germany | 24/295 |

*Primary Examiner*—Lanna Mai
*Attorney, Agent, or Firm*—Ancel W. Lewis, Jr.

[57] ABSTRACT

A fastening support device and system particularly suited for shielded gutters is disclosed. The device has upper and lower support arm portions spaced a fixed distance apart and shaped to fit under and nest inside complementary shaped sections of the gutter to hold the front free end portions of the gutter at the same elevation and maintain a substantially uniform gap in the gutter. A base portion connected to the arm portions abuts against the back wall of the gutter and a threaded fastener extends between the arm portions and through the base portion and back wall of the gutter to fasten the device to a support structure. A fastening support device for a two-piece shielded gutter allows the shield to be formed separate from the gutter and readily connect to and be detached from the gutter channel.

26 Claims, 3 Drawing Sheets

FASTENING SUPPORT DEVICES AND SYSTEMS FOR SHIELDED GUTTERS

This is a continuation-in-part of application Ser. No. 8/410,742 filed Mar. 27, 1995, now abandoned.

TECHNICAL FIELD

This invention generally relates to gutters for collecting run-off water from roofs and more particularly to a fastening support device and system for shielded gutters.

BACKGROUND ART

In U.S. Pat. No. 4,757,649 there is disclosed a shielded gutter with a top shield arranged to minimize the collection of debris and leaves inside the gutter. This shielded gutter has a spacer tube that extends from the back wall of the gutter to a front portion of the top shield and a fastener extends through a front portion of the top shield, the spacer tube, the back wall of the gutter and into a support structure to fasten the gutter thereto.

Williams U.S. Pat. No. 4,876,827 and Faulkner U.S. Pat. No. 5,388,377 disclose a hanger device that has a forward end portion that fits inside the top of the front wall of the gutter to support the front wall of the gutter. These patents do not have an upper support for the end of the shield that is integral with the lower support.

Goetz U.S. Pat. No. 2,672,832 discloses a removable cover forming a shield for a gutter that removably couples at the rear into the top wall of the gutter. This device uses a nail fastener that extends through the gutter and a separate nail fastener that extends through the cover.

DISCLOSURE OF THE INVENTION

A fastening support device for shielded gutters disclosed has an intermediate body portion, an upper support arm portion extending forwardly of the intermediate body portion that extends under and fits inside a free front end portion of a top shield, a lower support arm portion extending forwardly of the intermediate body portion that extends under and fits inside an inverted, inwardly inclined hook at the top of a front wall of the gutter. A rear base portion rearwardly of the intermediate body portion butts against the back wall of the gutter. A fastener extends through the intermediate body portion, base portion, and back wall of the gutter and into a support structure. A plurality of the devices at spaced intervals along the inside of the gutter form a fastening support system for the gutter.

A fastening support device for a two-piece shielded gutter has an additional coupling portion at the rear of the shield and device which allows the shield to be formed separately and be readily attached to and detached from the gutter.

BRIEF DESCRIPTION OF THE DRAWINGS

Details of this invention are described in connection with the accompanying drawings which like parts bear similar reference numerals in which.

DETAILED DESCRIPTION

Figure 2:
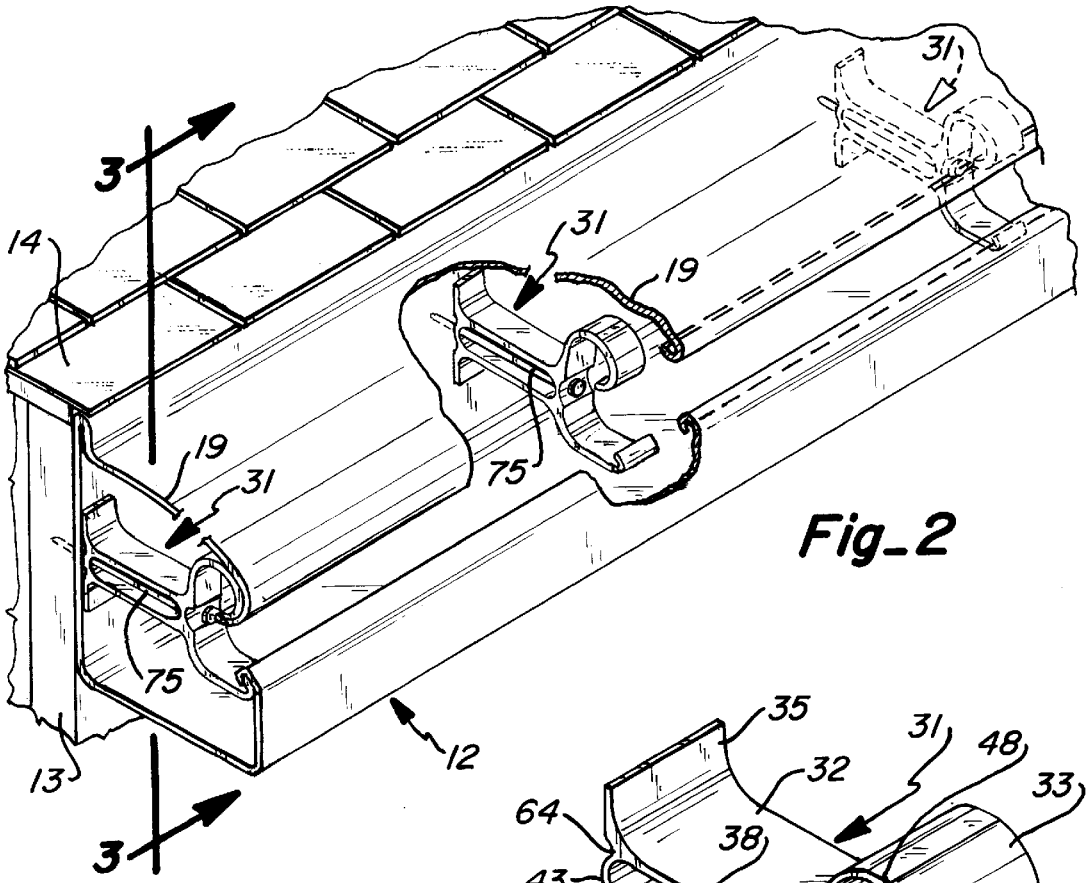
FIG. 2 is a perspective view of a fastening support system embodying features of the present invention using three of the devices shown in FIG. 1 and portions broken away to show interior construction.
Figure 1:
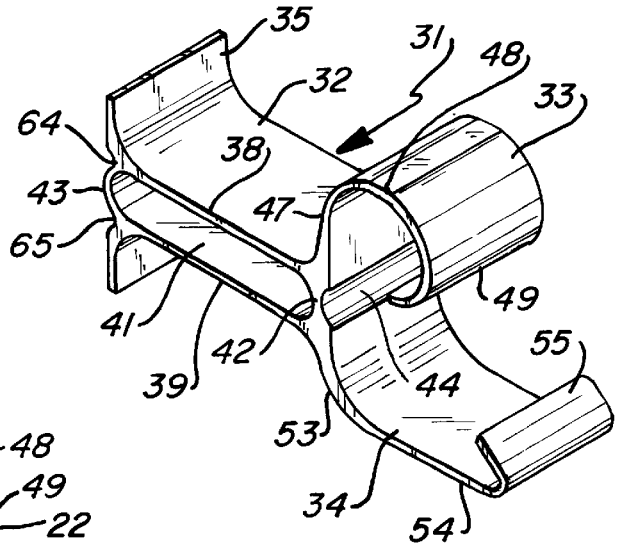
FIG. 1 is a front perspective view of a fastening support device for gutters embodying features of the present invention.
Figure 3:
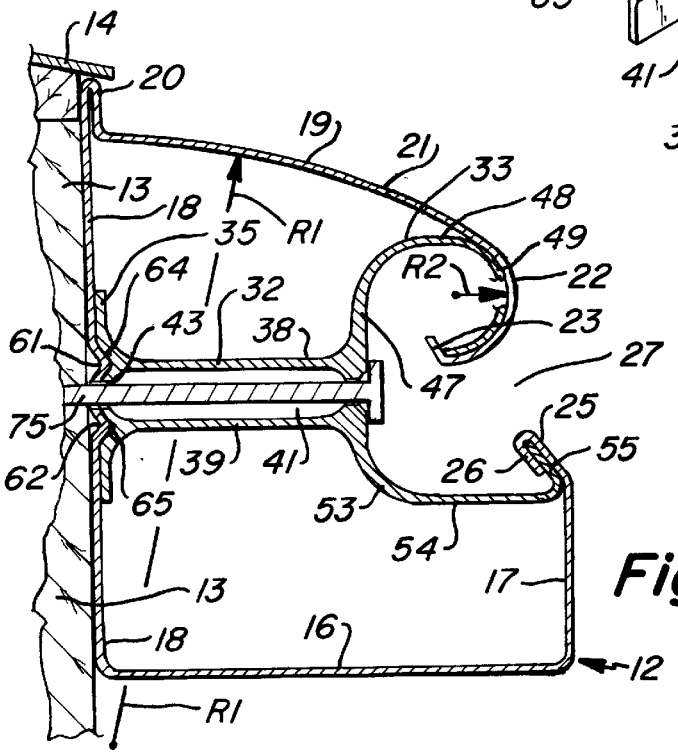
FIG. 3 is a sectional view taken along line 3—3 of FIG. 2.

Referring now to FIGS. 1–3 of the drawings there is shown a shielded gutter 12 mounted on a support structure 13 typically a fascia board having a roof 14. The shielded gutter 12 shown has a bottom wall 16, a front wall 17, and a back wall 18 forming a U-shaped channel or trough. A top shield 19 extends forwardly and downwardly away from the top of the back wall 18. A back-folded top section 20 connects the top of the back wall with the rear end of the top shield 19. The top shield 19 has a curved top section 21 formed along one radius R1 and a free front end portion 22 formed along another radius R2 through an arc of about 180 degrees and terminates in a rearwardly and upwardly extending end section 23 forming an open hem. The front wall 17 has a free top end portion 25 in the form of a backturned hook that inclines rearwardly from the front wall 17 with a back fold that terminates in a downturned end section 26. The inverted U-shaped hook in the free top end portion 25 is shown as inclined inwardly and rearwardly at an angle of about 45 degrees to the vertical. The downturned end section 26 may extend only to a vertical position forming a more open hook for a more easy insertion of the end section 55 of the device into the upper end of the front wall rather than folded past the vertical to press against section 55 as shown in FIG. 3.

The lower extremity of the front end portion 22 and the upper extremity of the free top end portion 25 define a longitudinal front opening or gap 27 along the gutter which provides access into the inside of the gutter 12. The free front end portion 22 of the shield is rearwardly of the free top end portion 25 of the front wall so that water falling on the top shield will fall into the gutter via the gap 27.

Three fastening support devices 31 embodying features of the present invention are shown mounted at spaced intervals along the inside of gutter 12 to provide a fastening support system for the gutter 12. Each fastening support device 31 shown includes an intermediate body portion 32, an upper support arm portion 33 and a lower support arm portion 34 with portions 33 and 34 extending forwardly from the front end of the intermediate body portion 32. Arm portions 33 and 34 are spaced a selected fixed distance apart. Body portion 32 and upper support arm portion 33 and lower support arm portion 34 shown are an elongated rigid support body which when anchored at the rear to the back wall provide a cantilever-type support for the shield and a rear base portion 35 extends transverse to the rear end of the intermediate body portion 32 and bears against the back wall 18 of the gutter 12. The device 31 shown may be made as an integral body of extruded aluminum, extruded plastic or injection molded plastic. The width of the device 31 shown preferably is about 0.5 to 1.0 inch and preferably about 0.75 inch.

The intermediate body portion 32 is an essentially hollow body having spaced upper and lower wall members 38 and 39 defining a longitudinal passage 41 closed at the ends with relatively thin web-like opposed front and rear weakened end walls 42 and 43. A fastener 75 described hereinafter will readily penetrate walls 42 and 43 when fastening forces such as hammer blows are applied to the head of the fastener. A front recess 44 is shown in the front wall to assist in locating the pointed end of the fastener so the fastener 75 penetrates and extends into and through the passage 41. The intermediate body portion typically is at least more than half the width of the gutter so as to extend beyond the back wall 18 more than half way into the gutter so that the pointed end of the fastener starts toward the front of the gutter rather than at the rear. The recess 44 forms a target area for the pointed end of the nail or screw fastener. Further, the intermediate body portion 32 is located relatively close to the front wall 17 and is between and aligned with the gap 27 so that the installer can insert the fastener 75 straight through the gap and against the front end wall of the intermediate body portion 32 of the fastener.

The upper support arm portion 33 has an upstanding curved rear section 47 extending up and forwardly from the front of the intermediate body portion 32, a top section 48 extending forwardly of the rear section 47 and a rearwardly opening curved front section 49 extending through an arc of about 180 degrees extending forwardly, down and rearwardly of the top section 48. The front section 49 is sized and shaped to nest in and bear against an inside surface of the free front end portion 22 of the top shield.

The top and front sections 48 and 49 of the upper support arm serve as what is herein referred to as a coupling portion at a front upper end portion of the rigid support body and more specifically are a semicircular section.

The front section 49 of the shield serves as what is herein referred to as a coupling portion at a bottom front end portion of the shield and more specifically is a semicircular section.

The semi-circular section of the device is received in and surrounded by the semi-circular section of the shield and they have mating surfaces arranged to interfit with one another so that when the device is placed within the gutter the device holds the front bottom end portion of the shield against movement.

The lower support arm portion 34 has a depending curved rear section 53 extending down and forwardly from the front of the intermediate bottom portion, a bottom section 54 extending forwardly of the rear section and an upstanding front section 55 that extends upwardly and rearwardly and at an angle from the front end of the bottom section 54. The angle shown is about 45 degrees to the vertical. The front section 55 is sized and shaped to nest in and bear against an inside surface of the hooked top or upper end portion 25. The upstanding front section 55 of the lower support arm portion 34 serve as what is herein referred to as a coupling portion at a front lower end portion of the rigid support body and more specifically is a male terminal section.

The hook-shaped upper end portion 25 of the front wall 17 serves as what is herein referred to as a coupling portion at an upper end portion of the front wall and more specifically is a female section.

This male terminal section 55 is received in and surrounded by the hook-shaped upper end portion 25 and they have nesting surfaces arranged to interfit with one another when the device is placed in the gutter to hold the upper end portion of the front wall against movement.

Each device 31 is typically set apart at 24 inch centers to correspond with the spacing between the studs. From the foregoing it is clear the device 31 holds the free front bottom end portion 29 of the shield and the top end portion 25 of the front wall of the gutter against forward, rearward, and up and down movement and in this way holds the gap 27 at a uniform width throughout the full length of the gutter.

The back wall 18 of the gutter is provided with a pair of spaced V-shaped projections 61 and 62 above and below the fastener 75 that extend inside the gutter to line up and fit in upper and lower indentations 64 and 65. The projections 61 and 62 of the back wall nest in the indentations 64 and 65 in the base so as to locate the base and the intermediate body portion 32 at a particular location with respect to the back wall of the gutter so as to locate the recess between the gap 27 so the fastener 75 may extend straight through the gap.

To install the device 31 each is slid through the end of the gutter to selected positions of a fastener 75 such as a nail or screw with a head at one end extends through the passage 41 and penetrates the support structure 13 adjacent the roof so as to secure the device 31 and gutter 12 to the support structure. The rigidity of the spaced support arms 33 and 34 maintain a substantially fixed or uniform spacing and elevation position for the opposed portions of the gutter forming the gap.

Figure 4:
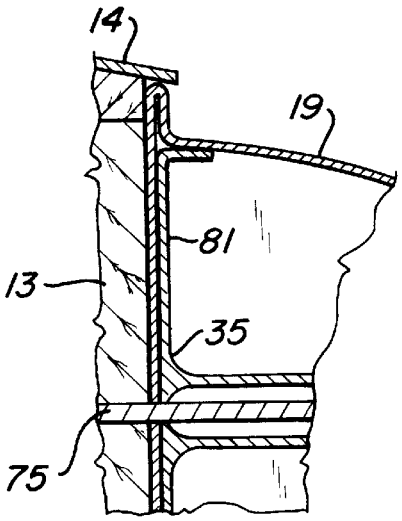
FIG. 4 is a fragmentary sectional view of a modified form of fastening support device with an upper locating extension.
Figure 5:
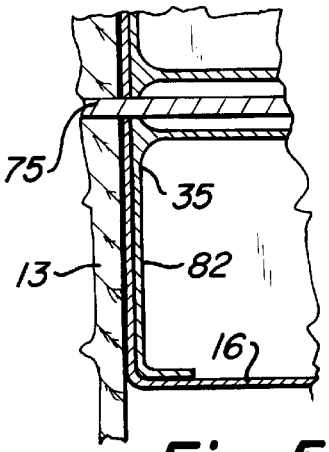
FIG. 5 is a fragmentary sectional view of a modified form of fastening support device with a lower locating extension.
Figure 7:
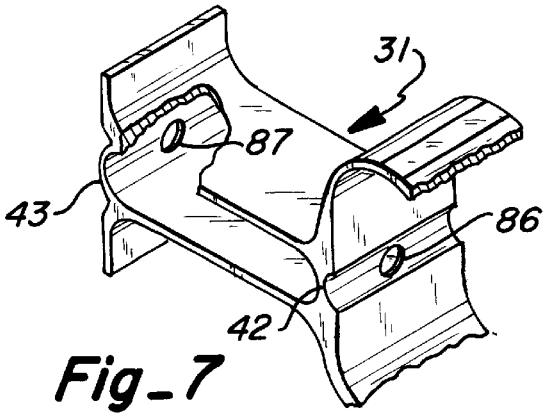
FIG. 7 is a fragmentary perspective view of a modified form of fastening support device with apertures in the intermediate body portion.
Figure 6:
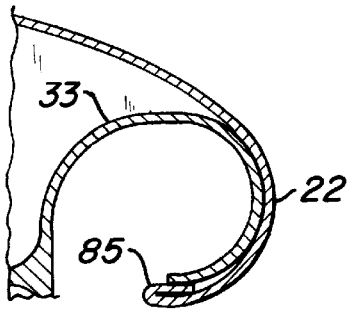
FIG. 6 is a fragmentary sectional view showing a gutter with a closed hem.

Referring now to FIG. 4 a modified form of device 31 removes the indentations 64 and 65 and projections 61 and 62 and utilizes a top end locating extension 81 on the top of the base 35 that extends up and forwardly at the end to bear against the inside surface of the top shield thereby locating the device inside the gutter. In FIG. 5 there is shown a bottom end locating extension 82 that extends down and forwardly and bears against the bottom wall 16 of the gutter to serve as a locator means for the device inside the gutter. It is understood that a further modification would be to provide both top and bottom locating extensions 81 and 82 on the base portion 35. In FIG. 6 there is shown a modified form of gutter having a front section that terminates in a backturned end section 85 forming a closed hem. A modified form of intermediate body portion shown in FIG. 7 is provided with aligned holes or apertures 86 and 87 in the front end wall and back rear end wall 43 through which the fastener may be inserted.

Figure 9:
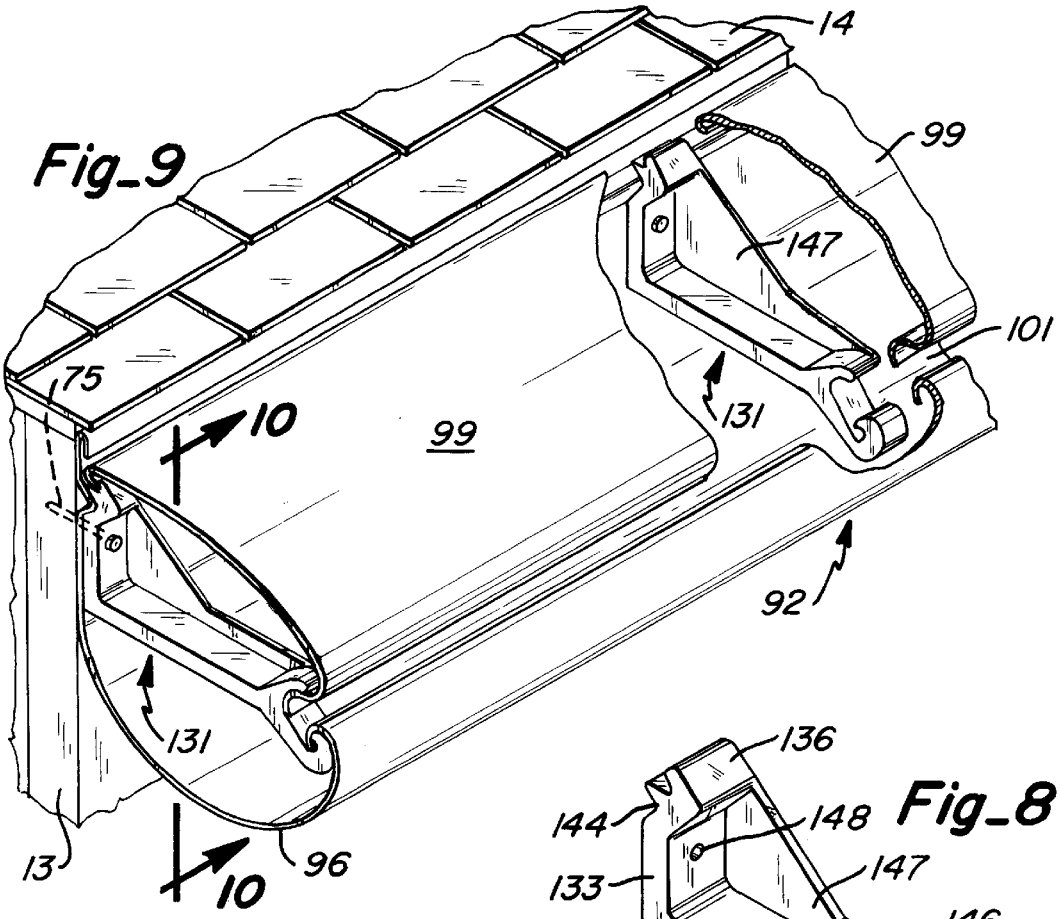
FIG. 9 is a perspective view of a fastening support system embodying features of the present invention using two of the devices shown in FIG. 8 with portions broken away to show interior construction.
Figure 8:
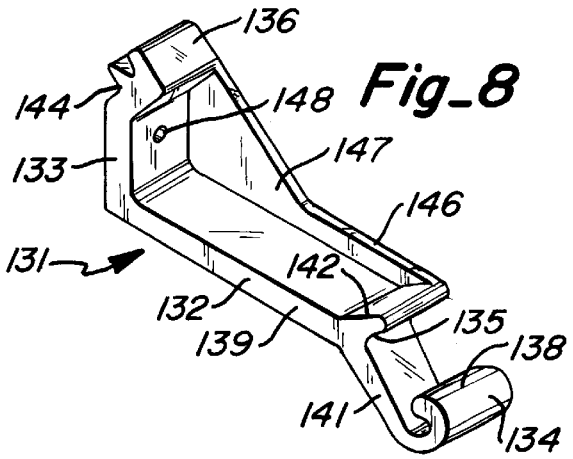
FIG. 8 is a front perspective view of another embodiment of a fastening support device for two-piece shielded gutters embodying features of the present invention.
Figure 10:
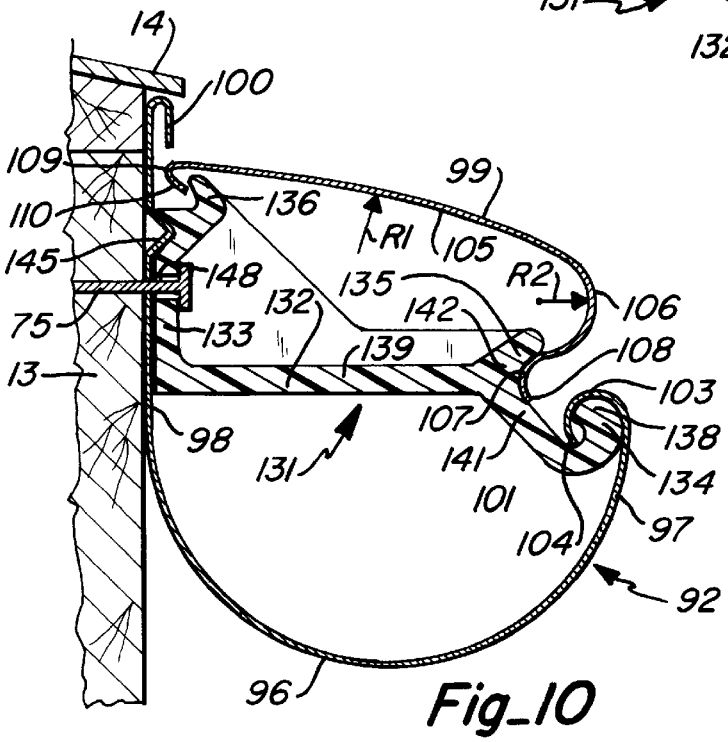
FIG. 10 is a sectional view taken along line 10—10 of FIG. 9.

Referring now to FIGS. 8–10 there is shown a two-piece shielded gutter 92 mounted on support structure 13 having a roof 14. The stationary gutter shown has a semicircular bottom wall 96, a front wall 97 and a back wall 98 forming a U-shaped gutter channel with a top opening. A removable top shield 99 extends downwardly and forwardly from the upper end or top of the back wall 98. The front bottom edge of the shield and the upper end portion of the front wall 97 form an opening or gap 101 extending along the front of the gutter through which water will run into the gutter channel and leaves and debris are prevented by the shield 99 from collecting in the gutter. The free front end portion or forward extremity of the shield 99 is rearwardly of the free upper end portion of the front wall 97 so water falling on shield 99 will fall into the gutter via gap 101.

The upper end of the back wall 98 has a top bend that extends forwardly and downwardly to form a top hook 100 that opens toward the bottom. A coupling portion 103 is provided at the upper end of the front wall 97 of the gutter. Coupling portion 103 extends upwardly, rearwardly, downwardly and forwardly from the upper end of the front wall through an arc of beyond 180 degrees to provide a curved hook opening toward the bottom with a down turned and front turned terminal section 104.

The top shield 99 is made from a flat sheet metal and shaped preferably by roll forming to have a convexly curved top portion 105 that extends forwardly and downwardly along a larger radius R1, a convexly curved front portion 106 formed along a second radius R2 and a front coupling portion 107 that is provided by a concavely curved front end portion that terminates in a front bottom edge 108. The top shield 99 has a rear coupling portion 109 that is provided by making a downturned bend at the rear end of the shield to provide a downwardly and forwardly extending rear hook that opens toward the front and has a terminal section 110.

Two fastening support devices 131 are shown mounted at spaced intervals along the inside of the gutter 92. Each fastening support device 131 shown is made as a rigid, one-piece, integral body having a rigid, elongated, main support body 132, a mounting base 133 at the rear end of the support body, a rigid coupling portion 134 at the bottom of the front lower end of the main support body, a rigid coupling portion 135 at the top of the front end of the main support body 132 and a rigid coupling portion 136 at the top of the mounting base 133. More particularly, the main support body 132 has a horizontal portion 139, a lower front inclined support arm portion 141 extending downwardly and forwardly from the front of said horizontal portion 139 and an upper front inclined support arm portion 142 extending upwardly and forwardly from the front of the horizontal portion 139. The main support body 132 is formed with a thin, web-like, horizontal rib section 146 and an inclined ramp rib section 147 which serves as a guide for installing the shield 99 as described hereinafter and adds structural strength to the device 131.

The mounting base 133 has an inwardly extending V-shaped detent 144 in the rear surface that fits over an inwardly extending V-shaped detent 145 in the back wall 98 which serves as a means to locate the mounting base 133 at a selected position on the back wall 98 when the device is inserted into the gutter. A hole or aperture 148 is provided in the mounting base through which the fastener 75 extends.

The coupling portion 134 at the front lower end portion of the main support body 132 interfits with the previously described coupling portion 103 at the upper end portion of the gutter front wall 97. These coupling portions 103 and 134 interfit with one another when the device is placed within the gutter and support the front wall against movement. Coupling portion 134 is in the form of a hook that opens at an angle toward the back and top along the axis of the inclined support arm portion 141 and has a terminal section 138 that extends rearwardly and upwardly generally parallel to support arm portion 141.

The rigid coupling portion 135 at the front upper end of the main support body interfits with the coupling portion 107 at the front bottom end portion of the shield. Coupling portion 135 is in the form of a hook with the end of support arm portion 141 forming a terminal section of the hook. Coupling portions 103 and 134 interfit with one another when the device 131 is placed in the gutter and fastened by fastener 75. Coupling portion 136 at the rear end of the mounting base interfits with the coupling portion 109 at the rear of the shield to support the rear end portion of the shield against movement. Coupling portion 135 at the front of the device and coupling portion 107 at the front of the shield interfit to support the front of the shield against movement. The coupling portions 107, 135 at the front of the shield and the coupling portions 109, 136 at the rear of the shield removably interfit to permit the shield to be readily removed from the gutter and reattached to the gutter as required.

The interfitting coupling portions on the device and gutter above described may be further characterized as substantially in the form of hooks. Each hook has a socket and a backturned male terminal section. The sockets of the interfitting hooks open in substantially oppositely facing directions and each terminal section slides into and fits within an associated socket. The male terminal section may be of the thickness of the member or may be curved or enlarged to have a shape that is complimentary with the shape of the associated concave socket. The pair of opposed, interfitting hooks may be a tight fitting or a loose fitting arrangement in the sockets as required to enable assembly and disassembly of the removable shield and provide the necessary support for the gutter.

To install each gutter 92, a fastening support device 131 and gutter 92 are first attached to the roof support structure 13 which is typically the facia board in a conventional manner. The devices 131 are fastened to the fascia board at spaced intervals such as two feet centers by a fastener 75 such as a nail or screw that extends through the device, through the back wall 98 of the gutter and into building support structure 131. The top shield 99 is then placed over the top opening of the gutter with the coupling portion 107 hooked into the coupling portion 135 and the coupling portion 109 hooked into the coupling portion 136. Because the shield can flex or expand along its length the coupling portion 107 may be slid up along the ramp section 147 and popped into coupling portion 136 due to the flexibility of the material. For removal of the shield either of the coupling portions 107 or 109 of the shield can be popped out of the associated coupling portions of the device.

Figure 11:
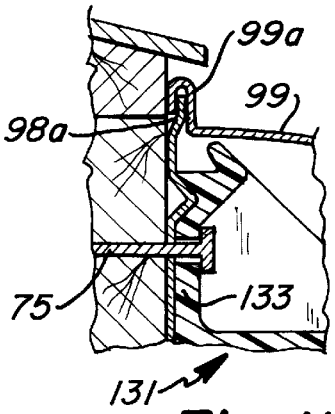
FIG. 11 is a schematic side elevation view of a modified fastening support device and modified two-piece gutter embodying features of the present invention.

Referring now to FIG. 11, a modified form of separate shield could have a hook 99*a* at the rear end of the shield opening toward the bottom that would fit down over the upper straight end 98*a* of the back wall of the gutter so the rear of the shield would attach to the gutter rather than the support device. Otherwise the device 131 and mounting for the shield would be the same as shown in FIGS. 9 and 10.

From the foregoing description it is clear that a fastening support device and system embodying features of the present invention can be easily made, is easy to install and once in place holds the gutter against movement, sagging and maintains a uniform gap through which the water passes while at the same time preventing debris from entering the inside of the gutter.

Although the present invention has been described with a certain degree of particularity, it is understood that the present disclosure has been made by way of example and that changes in details of structure may be made without departing from the spirit thereof.

What is claimed is:

1. A fastening support device for fitting inside and supporting an elongated shielded gutter having a bottom wall, front wall, back wall defining a gutter channel with a top opening and top shield extending forwardly and downwardly from the top of the back wall with a gap between the shield and front wall, said device comprising:

a main support body, a mounting base at the rear of said support body having means for receiving a fastener to anchor the rear of said support body to said back wall to provide a cantilever-type support for said shield and said front wall, a first coupling portion rigidly attached at the front lower end portion of said support body for interfitting with a gutter coupling portion at an upper end portion of said front wall to support said front wall against movement, and a second coupling portion rigidly attached at a front upper end portion of said support body for interfitting with a shield coupling portion at a front bottom end portion of said shield to support said shield against movement, said first and second coupling portions being rigid and at a fixed distance from one another to maintain said gap at a substantially uniform dimension.

2. A device as set forth in claim 1 wherein said main support body has an elongated horizontal portion, an inclined lower support arm portion extending downwardly and forwardly from the front of said horizontal portion, said first coupling portion being carried by said lower support arm portion and an inclined upper support arm portion extending upwardly and forwardly from the front of said horizontal portion, said second coupling portion being carried by said upper support arm portion.

3. A device as set forth in claim 2 wherein said horizontal portion has spaced upper and lower members defining a longitudinal passage through which said fastener extends, said horizontal portion having relatively thin, weakened, opposed front and rear end walls across the ends of said passage through which the fastener will readily penetrate when fastening forces are applied to the fastener, said front end wall having a recess in a front surface to provide a target area for receiving a pointed end of said fastener.

4. A device as set forth in claim 3 wherein there are holes in each of said front and rear walls through which said fastener will pass.

5. A device as set forth in claim 2 wherein said lower support arm portion has a depending curved rear section extending downwardly and forwardly from the front of said horizontal portion and a bottom section extending forwardly of said rear section, said first coupling portion being a front section extending up and rearwardly at an incline to said bottom section.

6. A device as set forth in claim 2 wherein said upper support arm portion has an upstanding curved rear section extending up and forwardly from the front end of said horizontal portion and a top section extending forwardly of said rear section, said second coupling portion means being a rearwardly opening curved front section extending through an arc of about 180 degrees.

7. A device as set forth in claim 1 wherein said mounting base has a first locator means for engaging a second locator means on said back wall to locate the mounting base at a selected vertical position on said back wall.

8. A device as set forth in claim 1 wherein said mounting base has a recessed target area for receiving a pointed end of said fastener.

9. A device as set forth in claim 1 wherein said mounting base has two vertically spaced indentations in a back face above and below said fastener adapted to fit over complementary shaped projections on the inside of said back wall to locate said mounting base at a selected vertical position on said back wall.

10. A device as set forth in claim 1 wherein said mounting base has a top extension that abuts against the underside of said top shield for locating said base portion at a selected vertical position on said back wall.

11. A device as set forth in claim 1 wherein said mounting base has a bottom extension that abuts against the bottom wall of the gutter for locating said base portion at a selected vertical position on said back wall.

12. A device as set forth in claim 1 wherein said main support body and said first and second coupling portion are made as an integral one-piece rigid body.

13. A device as set forth in claim 1 wherein said first coupling portion is substantially in the form of a hook having a rearwardly opening concave socket and a back-turned terminal section that extends upwardly and rearwardly at a selected angle to the vertical.

14. A device as set forth in claim 1 wherein said second coupling portion is substantially in the form of a hook having a rearwardly opening socket of a semi-circular shape and a backturned terminal section.

15. A device as set forth in claim 1 including a third coupling portion at an upper end of said mounting base for interfitting with a second shield coupling portion at the rear of said shield to support said shield against movement, said second and third coupling portion and said first and second shield coupling portions being releasable from one another to enable said shield to be readily attached to and removed from said gutter channel.

16. A fastening support device for fitting inside and supporting an elongated shielded gutter having bottom wall, front wall, back wall defining a gutter channel with a top opening and a top shield extending forwardly and downwardly from the top of the back wall with a gap between the top shield and the front wall, said device comprising:

a rigid main support body having spaced upper and lower members defining a longitudinal passage and having weakened, relatively thin, opposed front and rear end walls across the ends of said passage through which a fastener will readily penetrate when fastening forces are applied to the fastener, said front wall having a recess in a front surface to provide a target area for receiving the pointed end of said fastener, a lower support arm portion rigidly attached to and extending forwardly of said main support body portion, said lower support arm portion having a depending curved rear section extending forwardly from the front of said main support body and a bottom section extending forwardly of said rear section, a rigid first coupling portion for interfitting with a gutter coupling portion means and rigidly attached at the upper end portion of said front wall to support said front wall against movement, said first coupling means being a front section extending up and rearwardly at an incline to said bottom section, an upper support arm portion rigidly attached to and extending forwardly of said main support body, said upper support arm portion having a rearwardly opening, upstanding curved rear section extending up and forwardly from the front end of said main support body and a top section extending forwardly of said rear section, a rigid second coupling portion for interfitting with a shield coupling portion means and rigidly attached at a bottom front end portion of said shield to support said shield against movement, said second coupling portion being a curved front section extending forwardly of said top section through an arc of about 180 degrees, said first and second coupling portions being rigid and at a fixed distance from one another to maintain said gap at a substantially uniform dimension, and a mounting base extending transverse to and at the rear of said main support body for bearing against a back wall of the gutter, said main support body and mounting base having means for receiving a fastener that extends into a support structure for securing the gutter to the support structure to anchor the rear of said support body to said back wall to provide a cantilever-type support for said shield and said front wall.

17. A fastening support device for fitting inside and supporting an elongated shielded gutter having a bottom wall, front wall, back wall defining a gutter channel with a top opening and top shield extending forwardly and downwardly from the top of the back wall with a gap between the shield and front wall, said device comprising:

a main support body, a mounting base at the rear of said main support body having means for receiving a fastener to anchor the rear of said support body to said back wall to provide a cantilever-type support for said shield and front wall, a first coupling portion rigidly attached at the front lower end portion of said support body for interfitting with a gutter coupling portion at an upper end portion of said front wall to support said front wall against movement, a second coupling portion rigidly attached at a front upper end portion of said main support body for interfitting with a first shield coupling portion at a front bottom end portion of said shield to support said shield against movement, said first and second coupling portion being rigid and at a fixed distance from one another to maintain said gap at a substantially uniform dimension, and a third coupling portion at an upper end of said mounting base for interfitting with a second shield coupling portion at the rear of said shield to support said shield against movement, said second and third coupling portion and said first and second shield coupling portions being releasable from one another to enable said shield to be readily attached to and removed from said gutter channel.

18. The combination of an elongated shielded gutter having a bottom wall, a front wall having a front wall coupling portion at an upper end portion of the front wall, a back wall defining a gutter channel with a top opening and a top shield extending forwardly and downwardly from the top of the back wall with a gap between the shield and the front wall, said shield having a shield coupling portion at a front bottom end portion of the shield and a fastening support device inside and supporting said gutter, said device including:

an elongated horizontal main support body, an elongated vertical mounting base at the rear of said support body having means for receiving a fastener to anchor the rear of said support body to said back wall to provide a cantilever-type support for said shield and said front wall, a first coupling portion rigidly attached at the front lower end portion of said support body interfitting with said front wall coupling portion to support said front wall against movement and maintain said gap of a substantially uniform dimension, and a second coupling portion rigidly attached at the front upper end portion of said support body interfitting with said shield coupling portion to support said shield against movement and maintain said gap at a substantially uniform dimension.

19. The combination as set forth in claim 18 wherein a front wall of said main support body is located at a forward position past the middle of the gutter to facilitate insertion of a point of said fastener into said main support body.

20. A device as set forth in claim 18 wherein said first coupling portion and said front wall coupling portion are each substantially in the form of a hook with each said hook having a concave socket and a backturned terminal section, said sockets of said interfitting hooks opening in substantially oppositely facing directions and each terminal section fitting within an associated socket.

21. A device as set forth in claim 18 wherein said second coupling portion and said shield coupling portion are substantially in the form of a hook with each said hook having a concave socket and a backturned terminal section, said sockets of said interfitting hooks opening in substantially opposite facing directions and each terminal section fitting within an associated socket.

22. The combination in a fastening support system of an elongated shielded gutter having a bottom wall, a front wall having a front wall coupling portion at an upper end portion of the front wall, a back wall defining a gutter channel with a top opening and a top shield extending forwardly and downwardly from the top of the back wall with a gap between the shield and the front wall, said shield having a shield coupling portion at a front bottom end portion of the shield and a plurality of fastening support devices at selected spaced distances inside and supporting said gutter, each said device including:

an elongated horizontal main support body, an elongated vertical mounting base at the rear of said support body having means for receiving a fastener to anchor the rear of said support body to said back wall to provide a cantilever-type support for said shield and said front wall, a first coupling portion rigidly attached at the front lower end portion of said support body interfitting said front wall coupling portion to support said front wall against movement, and a second coupling portion rigidly attached at the front upper end portion of said support body interfitting with said shield coupling portion to support said shield against movement, said first and second coupling portion of said devices being rigid and at a selected fixed distance apart to maintain a substantially uniform gap throughout the length of said gutter.

23. The combination of an elongated shielded gutter having a bottom wall, a front wall having a front wall coupling portion at an upper end portion of the front wall, a back wall defining a gutter channel with a top opening and a top shield extending forwardly and downwardly between the from the top of the back wall with a gap shield and front wall said shield having a first shield coupling portion at a front bottom end portion of the shield and a second shield coupling portion at the rear of said shield and a fastening support device inside and supporting said gutter, device including:

a main support body, a mounting base at the rear of said support body having means for receiving a fastener to anchor the rear of said support body to said back wall to provide a cantilever-type support for said shield and said front wall, a first coupling portion rigidly attached at the front lower end portion of said support body interfitting said front wall coupling portion to support said front wall against movement and maintain a substantially uniform gap, and a second coupling portion rigidly attached at the front upper end portion of said support body interfitting with said shield coupling portion to support said shield against movement and maintain a substantially uniform gap, a third coupling portion at an upper end of said mounting base for interfitting with a second shield coupling portion at the rear of said shield to support said shield against movement, said first and second coupling portions being rigid and at a fixed distance from one another to maintain said gap at a substantially uniform dimension, said second and third coupling portion and said first and second shield coupling portions being releasable from one another to enable said shield to be readily attached to and removed from said gutter channel.

24. A device as set forth in claim 23 wherein said third coupling portion and said second shield coupling portion are each substantially in the form of a hook with said hook having a concave socket and a backturned terminal section, said sockets of said interfitting hooks opening in substantially oppositely facing directions and each terminal section fitting within an associated socket.

25. A device as set forth in claim 23 wherein said main support body, mounting base, first coupling portion means, second coupling portion, and third coupling portion are made as an integral one-piece rigid body.

26. A fastening support device for fitting inside and supporting an elongated shielded gutter having a bottom wall, front wall, back wall defining a gutter channel with a top opening and top shield extending forwardly and downwardly from the top of the back wall with a gap between the shield and front wall, said device comprising:

a main support body, a mounting base at the rear of said support body adapted to receive a fastener to anchor the rear of said support body to said back wall to provide a cantilever-type support for said shield and said front wall, a first coupling portion means at the front lower end portion of said support body for interfitting with a gutter coupling portion means at an upper end portion of said front wall to support said front wall against movement, and a second coupling portion means at a front upper end portion of said support body for interfitting with a shield coupling portion means at a front bottom end portion of said shield to support said shield against movement, said first and second coupling portion means being a fixed distance from one another to maintain said gap at a substantially uniform dimension, said main support body being formed with a thin web-like horizontal rib section and an inclined rib section that serves as a guide for installing said shield and adds structural strength to said main support body.

* * * * *

UNITED STATES PATENT AND TRADEMARK OFFICE

CERTIFICATE OF CORRECTION

PATENT NO. : 5,845,435
DATED : December 8, 1998
INVENTOR(S) : Gary A. Knudson

It is certified that error appears in the above-identified patent and that said Letters Patent is hereby corrected as shown below:

Title page,
Item [63], Related U.S. Application Data, should appear as follows:
-- continuation of PCT/US96/0131 filed February 6, 1996 which is a continuation - in - part of serial no. 410,742, March 27, 1995 abandoned. --

Signed and Sealed this

Eighteenth Day of November, 2003

JAMES E. ROGAN
*Director of the United States Patent and Trademark Office*